United States Patent [19]

Lampe et al.

[11] 4,156,924

[45] May 29, 1979

[54] CMOS ANALOG MULTIPLIER FOR CCD SIGNAL PROCESSING

[75] Inventors: Donald R. Lampe, Ellicott City; Hung C. Lin, Silver Spring; Marvin H. White, Columbia, all of Md.

[73] Assignee: Westinghouse Electric Corp., Pittsburgh, Pa.

[21] Appl. No.: 842,866

[22] Filed: Oct. 17, 1977

[51] Int. Cl.[2] ..... G06G 7/16

[52] U.S. Cl. ..... 364/844; 307/221 D; 364/862

[58] Field of Search ..... 307/229, 221 D, 221 C; 328/160; 357/24; 364/862, 841, 844

[56] References Cited

U.S. PATENT DOCUMENTS

| | | | |
|---|---|---|---|
| 3,956,624 | 5/1976 | Audaire et al. | 364/862 |
| 4,032,767 | 6/1977 | Lagnado | 364/862 |
| 4,052,606 | 10/1977 | Heller et al. | 364/862 X |
| 4,071,777 | 1/1978 | Herrmann | 364/841 X |
| 4,084,256 | 4/1978 | Engeler et al. | 364/862 |

OTHER PUBLICATIONS

Bosshart-"An Integrated Analog Correlator Using Charge-Coupled Devices"-1976 IEEE International Solid-State Circuits Conference-Digest of Technical Papers, pp. 198, 199.

*Primary Examiner*—Joseph F. Ruggiero
*Attorney, Agent, or Firm*—H. W. Patterson

[57] ABSTRACT

An analog multiplier for multiplying the signals derived from a charge coupled device (CCD) tap includes a balanced multiplier of a first conductivity-type and a buffer of a second conductivity-type coupled between the CCD tap and the balanced multiplier. The multiplier includes first and second transistors, the drains of which are coupled together to form an input. The buffer includes a load transistor coupled to the output of an amplifying transistor. Means are included for coupling the output of the amplifier transistor and the multiplier input.

6 Claims, 5 Drawing Figures

CMOS ANALOG MULTIPLIER FOR CCD SIGNAL PROCESSING

GOVERNMENT CONTRACT

The invention herein described was made in the course of or under a contract or subcontract thereunder with the National Aeronautics and Space Administration.

BACKGROUND OF THE INVENTION

1. Field of the Invention

This invention relates to analog multipliers and, more particularly, to balanced triode analog multipliers for multiplying signals derived from CCD taps.

2. State of the Prior Art

Analog multipliers are used, for example, as weighting elements for charge coupled device (CCD) signal processing applications, such as correlators, convolvers, and transversal filters. This multiplying function can be achieved using an MOS transistor operating in its linear or triode region. A balanced triode multiplier has been used to achieve this goal. In a CCD, a signal is typically tapped from a floating gate which signal is typically a current. However, conductance multiplication using balanced triodes is only effective if the drain input signal is a voltage. Therefore, a buffer has been placed between the floating gate of the CCD and the drain-input to the multiplier. This buffer can be a unity gain inverter.

In order for the balanced triode multiplier to operate linearly (without distortion), the transistors must be operated in the triode region. To effect this goal, the input-drain voltage should be substantially at the same potential as the source terminals of the multiplier. When the transistors in the multiplier and the transistors in the buffer are of the same conductivity type, and the DC potentials derived from the CCD stages are substantially the same, biasing the multiplier into the triode region is difficult because the DC levels derived from the CCD stages cannot provide potentials appropriate to operate the multiplier in the triode region. The result is that the multiplier is linear for only a small range of drain-input voltages. CCD stages with different tap potentials can be used. However, this alternative is inconvenient and impractical.

It is desired that an MOS conductance multiplier be provided that has linear multiplying characteristics for a wide range of drain-input voltages.

SUMMARY OF THE INVENTION

In accordance with the multiplier of the present invention, complementary metal-oxide-semiconductor (MOS) transistors are used as buffers between stages of a charge coupled device (CCD) and a MOS conductance multiplier in order to shift the level of the DC potential present at the CCD stages to appropriate levels for operating the multiplier in the triode region. The multiplier of the invention provides such operations using CCD stages, the output potentials of which are substantially the same.

According to one embodiment of the invention, a CMOS analog multiplier for CCD signal processing comprises a balanced multiplier circuit including two transistors of a first conductivity type operating in the triode region. The drains of the multiplier transistors are coupled together to provide an input. A buffer circuit, the output of which is coupled to the input of the multiplier circuit, includes two transistors of a second conductivity type. One of the buffer transistors acts as a low output impedance load device to provide the low impedance signal level required for effective operation of the balanced MOS conductance multiplier circuit. The drain and gate of the load transistor are tied together which turns ON the load transistor and provides the desired low impedance buffer output. The second transistor of the buffer circuit is an amplifier, typically of unity gain. The gate of the amplifier transistor provides an input to the device of the invention which can be coupled to a CCD floating gate. The source of the load transistor and the drain of the amplifier transistor are coupled together and form an output of the buffer circuit. The buffer output is coupled to the multiplier input. The gates of the multiplier transistors can be coupled to floating gates of another CCD. Current in the sources of the multiplier transistors is indicative of the product of the signals derived from the CCD floating gate inputs.

Since the transistors in the buffer circuit are of a conductivity type complementary to the conductivity type of the multiplier transistors, the buffer circuit can provide an output signal substantially at ground potential in response to a signal applied to the gate of the amplifier transistor.

In one aspect of this embodiment, the multiplier transistors are N-channel devices, and the buffer transistors are P-channel devices. In another aspect of the invention, the multiplier transistors are P-channel devices and the buffer transistors are N-channel devices.

Other combinations of complementary MOS transistors for buffering CCD signals to a balanced conductance multiplier are possible in order to achieve the above result as will be seen from the following detailed description.

DESCRIPTION OF THE PREFERRED EMBODIMENT

Figure 1:
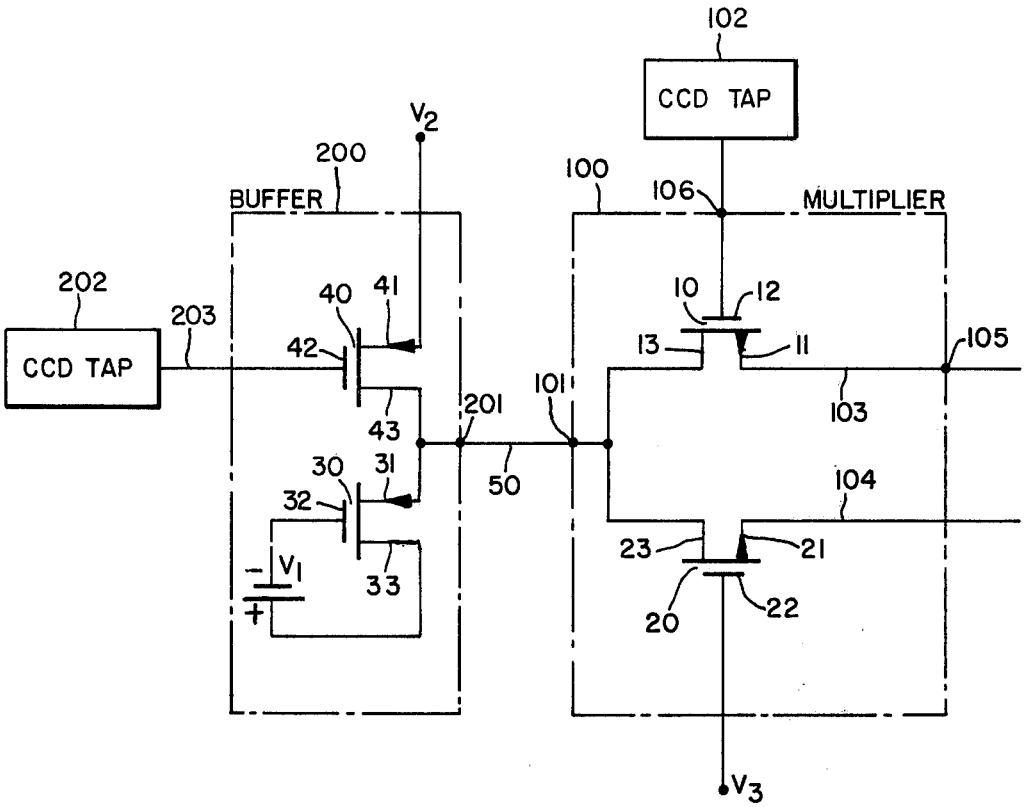
FIG. 1 shows an embodiment of the present invention utilizing only one input buffer.

FIG. 1 shows a circuit drawing of a CMOS analog multiplier according to the present invention. A multiplier circuit within the lines at 100 includes N-channel enhancement mode transistors 10 and 20, respectively having sources 11 and 21, gates 12 and 22, and drains 13 and 23. The buffer within the lines at 200 includes transistors 30 and 40, having, respectively, drains 33 and 43, gates 32 and 42, and sources 31 and 41. The drains 13 and 23 are coupled together and form multiplier input 101 and the drain 43 and the source 31 are coupled together and form buffer output 201. A line 50 couples the buffer output 201 to the multiplier input 101. Battery $V_1$ is coupled between gate 32 and drain 33 in order to turn ON transistor 30. A CCD tap 202 applies a DC potential to gate 42. Source 41 is coupled to a DC potential $V_2$ being more positive than the DC potential applied by tap 202. A CCD tap 102 applies a DC potential to gate 12 of transistor 10 and gate 22 of transistor 20 is coupled to a DC potential $V_3$ which can be equal to the DC potential of tap 102. When $V_3$ is not equal to the DC potential of tap 102, an error signal proportional to the potential difference between the two appears as a component of the product of the signals desired to be multiplied.

Figure 2:
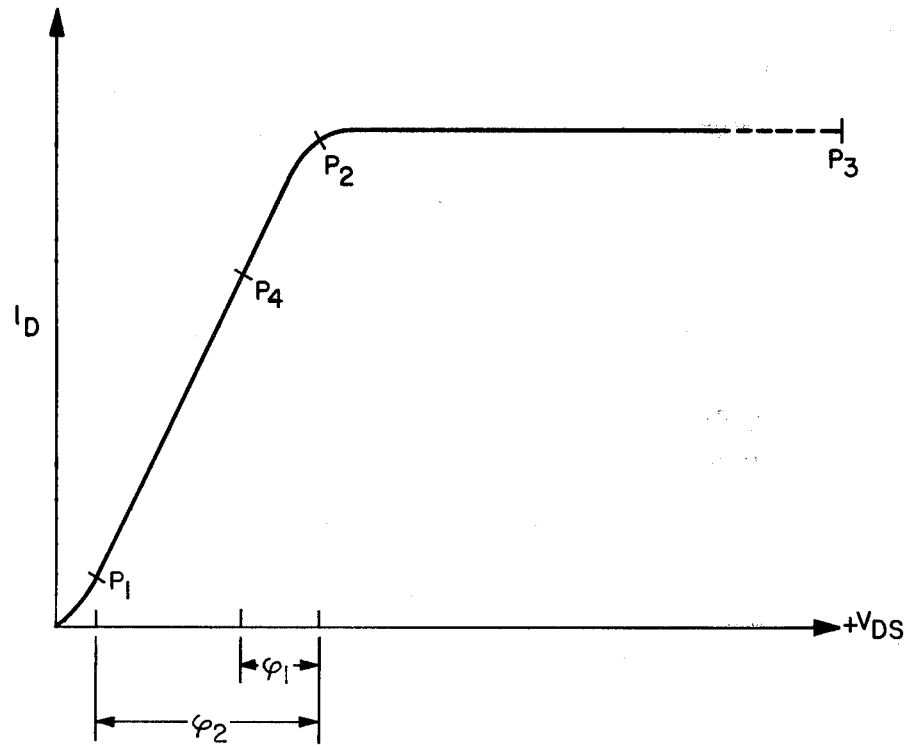
FIG. 2 is a graph of drain current vs. drain voltage for a multiplier of the type used in the embodiment of the present invention of FIG. 1.

Transistors 10 and 20 operate in the triode region which region is shown by curve portion $P_1$–$P_2$ in FIG. 2. This is also called the linear region because the curve is substantially linear between the points a and b. This, of course, is the preferred operating region for linear multiplication. The abscissa of the graph of FIG. 2 is a measure of the positive potential applied to the gate 12 from CCD tap 102. The ordinate of the graph of FIG. 2 is a measure of the current flowing in the drains 13 and 23. In order for an enhancement mode N-channel MOS transistor to operate in the triode region, the gate potential must be more positive than the drain potential. For example, the DC potential of the gates 12 and 22 must be more positive than the potential of the coupled drains 13 and 23. For best results, it is desired that the quiescent drain potential $V_{DS}$ at terminal 101 be substantially at the same potential as the sources 11 and 12, $P_1$. If the quiescent drain potential of the coupled drains 13 and 23 were at $P_4$, for instance, as shown in FIG. 2, a signal of magnitude $U_1$ applied to the drains 13 and 23 would cause the operation of the device to move into a pentode region designated by the curve portion $P_2$–$P_3$ of FIG. 2. Multiplication in the pentode region is nonlinear, and therefore is undesirable. If, however, the quiescent drain potential of the coupled drains 23 and 13 were at the point $P_1$, a much larger signal voltage $U_2$ must be applied before the transistors move into the pentode region where nonlinear multiplication occurs. A quiescent drain potential at substantially the same potential as the sources 11 and 12, for example the point $P_1$ and FIG. 2, allows greater input signal excursions before multiplier nonlinearities occur. For example, in FIG. 1, if a CCD floating gate 102 provided a potential of +2 volts at the gates 12 and 22, it is desired that the coupled drains 13 and 23 be at a potential of zero volts.

In FIG. 1, the transistor 40 typically operates in the pentode region as a unity gain amplifier. Such operation requires that the potential applied to gate 42 be more positive than the potential of the source 43. For example, the potential of the gate 42 should be higher than the potential of the source 41. Under these conditions, if a potential of +2 volts, for example, is applied to the gate 42 from a CCD tap 202, the potential of the source 41 will be substantially near zero volts. The coupling of the gate 32 to the drain 33 is effective to turn on the transistor 30 to provide a low impedance output at the buffer output 201. A line 50 couples the buffer output 201 to the multiplier input 101. The buffer 200, then, shifts the level of the voltage derived from the CCD tap 202 in order to provide at the output 201 a low impedance drive of a potential appropriate for the linear operation of the multiplier 100. It is desired that the impedance of the buffer 200 be low in order to minimize any feedback or cross-talk. The difference in the current in the lines 103 and 104 coupled to the sources 11 and 21, respectively, is indicative of the product of the signals applied to the gates 12 and 42 from the CCD taps 102 and 202.

Figure 3:
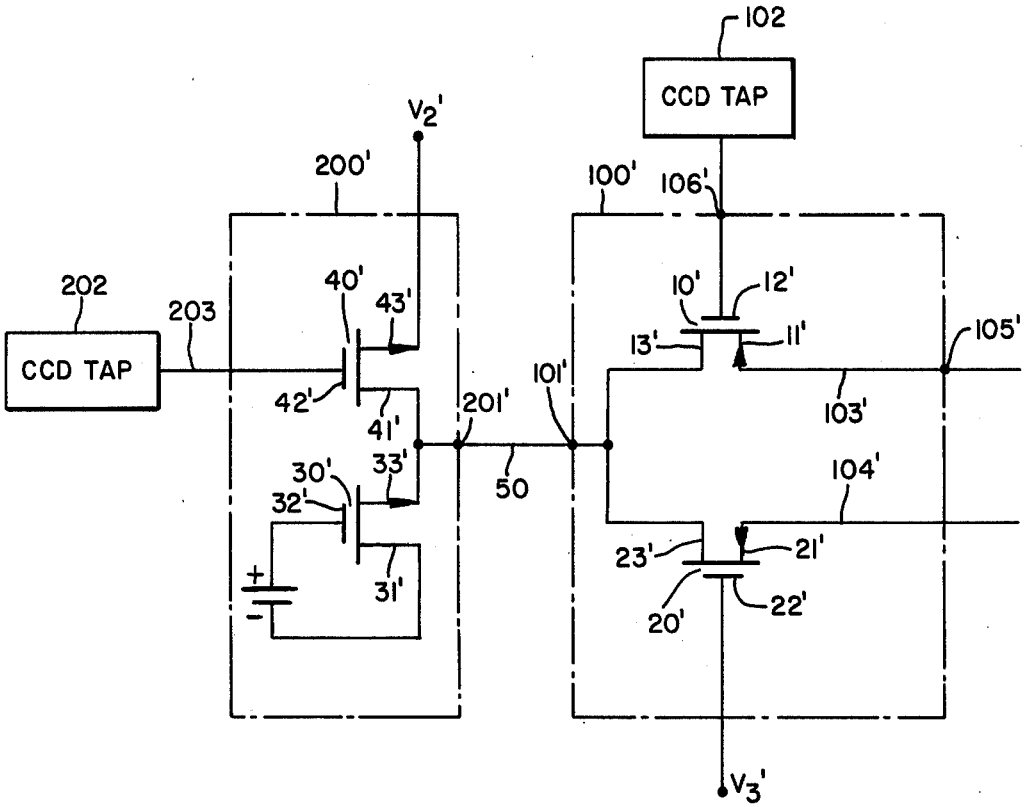
FIG. 3 is an embodiment of the present invention wherein the transistors are of opposite conductivity to the transistors of FIG. 1.

In FIG. 3, the transistors 10' and 20' are P-channel enhancement mode transistors and the transistors 40' and 30' are N-channel enhancement mode transistors. The primed characters of FIG. 3 denote similar elements of reversed conductivity type from the elements in FIG. 1. The operation of the embodiment shown in FIG. 3 is identical to that explained with reference to FIG. 1 except that the polarity of the voltages applied to the gates 12' and 42' must be reversed from the polarity of the voltages applied to the gates 12 and 42 in FIG. 1. The polarity of the battery $V_1$ and the potentials $V_2$ and $V_3$ must also be reversed. The result is designated as $V_1'$, $V_2'$ and $V_3'$. Under the above conditions, the buffer output 201 will supply a low impedance drive for the multiplier 100'.

Figure 4:
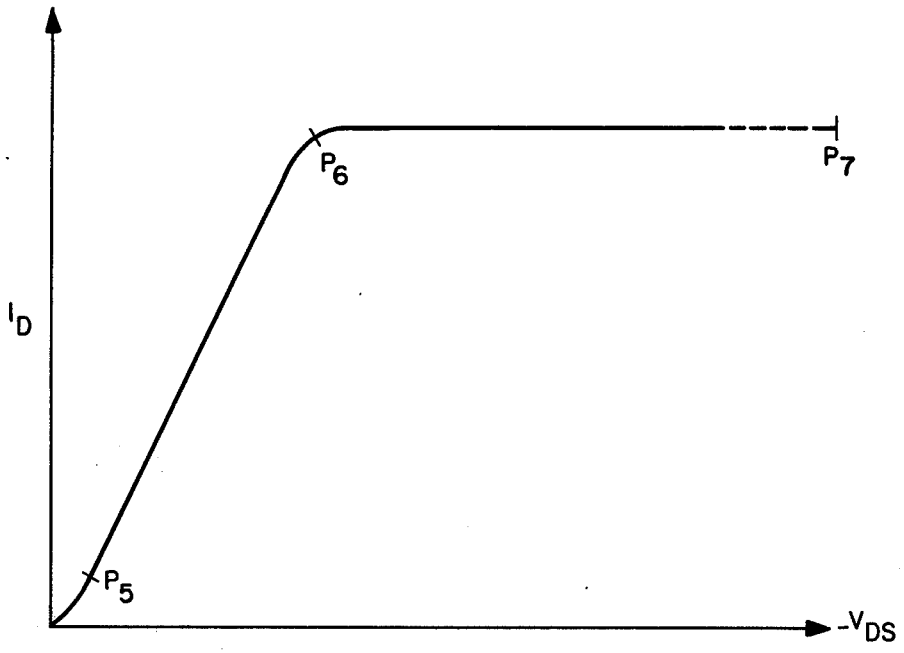
FIG. 4 is a graph of drain current vs. drain voltage for a multiplier of the type used in the embodiment of FIG. 3.

For example, the drains 13' and 23' must be at substantially ground potential in order for the transistors 20' and 10' to operate in the linear region for a wide range of drain-input voltages as shown in the FIG. 4 by the curved portion $P_5$–$P_6$. The abscissa of the graph of FIG. 4 is a measure of the negative potential applied to the gate 12' from the CCD tap 102. The ordinate of the graph of FIG. 4 is a measure of the current flowing in the drains 13' and 23'. For reasons explained hereinbefore, it is desirable to drive the drains 13' and 23' which are coupled to the multiplier input 101' by a low impedance low potential signal, such as the signal at the point $P_5$ in FIG. 4.

Referring back to FIG. 3, the transistor 40' operates in the pentode region. Therefore, the gate 42' is at a lower potential than the source 41'. For example, if a potential of −2 volts is applied to the gate 42' from the CCD tap 202, the gate to source of voltage drop would produce a potential of near zero volts at the source 41'. The buffer 200', then, shifts the level of the voltage derived from the CCD tap 202 in order to provide at the output 201 a low impedance drive of a potential appropriate for operating the multiplier 100' in the triode region. The transistor 30' provides the low impedance drive needed for effective conductance multiplication by the multiplier 100'.

Figure 5:
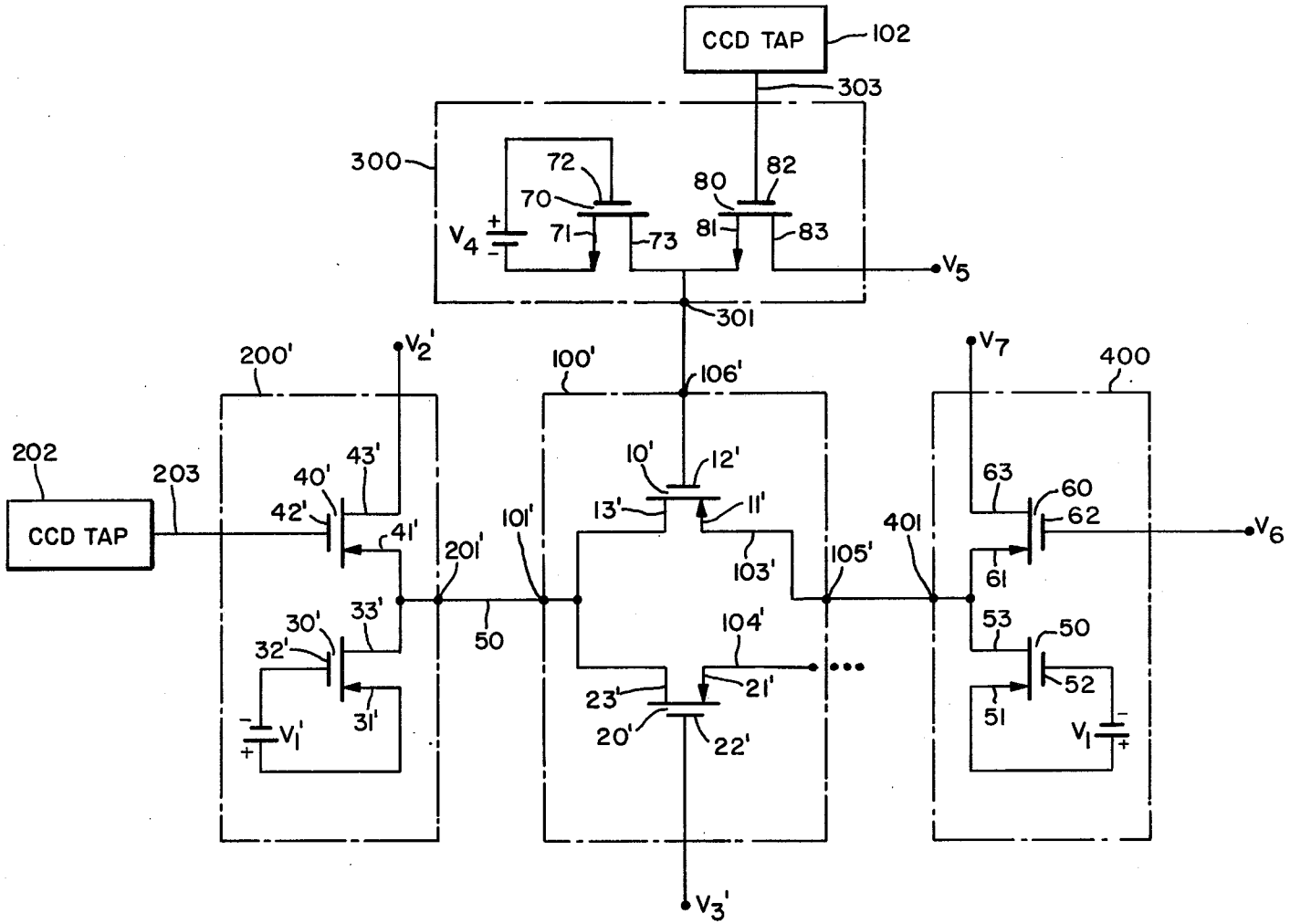
FIG. 5 is another embodiment of the present invention utilizing two input buffers.

FIG. 5 shows another embodiment of the present invention. In addition to the circuitry of FIG. 3, a buffer within the lines at 300 is coupled between the CCD tap 102 and the gate 12', which buffer includes N-channel enhancement mode transistors 70 and 80, respectively having sources 71 and 81, gates 72 and 82, and drains 73 and 83. The two transistors 70 and 80 are coupled together in a source-follower fashion. CCD tap 102 is coupled to gate 82 and the drain 73 and the source 83 are coupled together and to an output terminal 301. Output 301 is coupled to gate 12'. Battery $V_4$ is coupled between gate 72 and source 71 in order to turn ON transistor 70. The battery $V_4$ should be of a potential more negative than the potential desired to be applied to gate 12' from output 301. For example, if a −8 V is desired to be applied to gate 12' where CCD tap 102 is at a potential of approximately −4 V, then the battery $V_4$ can be at −15 V, for example. The drain 83 is coupled to a potential $V_5$, which potential is more positive than the potential of CCD tap 102.

As mentioned hereinbefore, it is desired that the sources 11' and 21' be at the same potential as the drains 13' and 23'. A circuit within the lines at 400, for example, provides such a potential, which circuit 400 includes N-channel enhancement mode transistors 50 and 60 having, respectively, sources 51 and 61, gates 52 and 62, and drains 53 and 63. The two transistors 50 and 60 are coupled together in a source-follower fashion. Drain 53 is coupled to source 61 and to output terminal 401. The battery $V_1$ is coupled between source 51 and gate 52 in order to turn ON transistor 50. Gate 62 is coupled to a potential $V_6$ substantially the same as the potential derived from CCD tap 202. Drain 63 is coupled to a potential $V_7$ which is adjusted to provide at output 401 a potential substantially equal to the potential at terminal 101.

The buffer 300 is effective to shift the level of the potential of CCD tap 102 and to minimize cross-talk or voltage feedback. In the example above, the level is shifted from −4 V at the CCD tap 102 to −8 V applied to the gate 12', which applied voltage is appropriate to operate the multiplier 100' in the triode region.

The present invention provides a multiplier which can be operated in the triode region from CCD taps, the DC potentials of which are substantially the same.

What we claim is:

1. A device for multiplying analog signals comprising:

a. multiplier means of a first conductivity type having a first and second input and two outputs for providing a signal on said outputs indicative of the product of signals applied to said inputs;

b. buffer means of a second conductivity type coupled to said multiplier means for shifting the level of a potential derived from a charge coupled device (CCD) stage tap and applying said shifted level potential to said multiplier means.

2. The device of claim 1 wherein said multiplying means includes first and second transistor operating in the triode region, each having a source, a gate, and a drain, said drains coupled together for providing an input, whereby, when a first signal is applied to said multiplier input and a second signal is applied to the gate of one of said transistors, current flows in the sources of said transistors indicative of the products of said first and second signals.

3. The device of claim 2 wherein said buffer means includes third and fourth transistors, each having a source, a gate, and a drain, the gate and source of said third transistor coupled together for providing a low impedance load device, the drain of said third transistor and the source of said fourth transistor coupled together and forming a first output, whereby, when a signal of a first potential is applied to the gate of said second transistor, a signal of a second potential is provided on said first output.

4. The device of claim 3 further comprising buffer means including fifth and sixth transistors, each having a source, a gate, and a drain, the gate and source of said fifth transistor coupled together for providing a low impedance load device, the drain of said sixth transistor and the source of said fifth transistor coupled together and forming a second output, whereby, when a signal of a first potential is applied to the gate of said sixth transistor, a signal of a second potential is provided on said second output.

5. A device of claim 3, wherein said first conductivity type is P-type and said second conductivity is N-type.

6. A device of claim 3, wherein said first conductivity type is N-type and said second conductivity type is P-type.

* * * * *